United States Patent [19]

Kataishi et al.

[11] 4,402,484

[45] Sep. 6, 1983

[54] MOLDING TOOL DEVICE FOR A MOLDING USED IN AN ARCHITECTURAL STRUCTURE

[75] Inventors: Takao Kataishi; Iwazou Seo, both of Tokyo, Japan

[73] Assignee: Misawa Home Company, Ltd., Tokyo, Japan

[21] Appl. No.: 313,398

[22] Filed: Oct. 20, 1981

[30] Foreign Application Priority Data

May 28, 1981 [JP] Japan ..... 56/81744

[51] Int. Cl.[3] ..... B28B 7/02

[52] U.S. Cl. ..... 249/129; 249/139; 249/158; 249/162; 249/165

[58] Field of Search ..... 249/139, 129, 158, 162, 249/165

[56] References Cited

U.S. PATENT DOCUMENTS

| | | | |
|---|---|---|---|
| 3,618,181 | 11/1971 | Veale | 249/129 |
| 3,844,524 | 10/1974 | Fisher | 249/129 |
| 3,931,951 | 1/1976 | Fougea | 249/158 |
| 4,289,293 | 9/1981 | Cashion | 249/161 |

*Primary Examiner*—John A. Parrish

*Attorney, Agent, or Firm*—Flynn, Thiel, Boutell & Tanis

[57] ABSTRACT

A molding tool device for a molding used in an architectural structure, in which a plurality of side frames are squarely arranged on a bed to define a space for a molding of concrete panel or the like.

In this molding tool device, some of the side frame or frames detachably mounted on the bed and the remaining side frames are provided so as to be released from the respective side surface of the molding defined by these side frames by means of connectors each provided thereon with a link mechanism for connecting the side surface of the side frame to the bed, so that the molding can be readily released in an erected state of the bed.

11 Claims, 13 Drawing Figures

MOLDING TOOL DEVICE FOR A MOLDING USED IN AN ARCHITECTURAL STRUCTURE

BACKGROUND OF THE INVENTION

1. Field of the Invention

The present invention relates to a molding tool device for forming a concrete panel or the like formed of raw materials for a molding such as cement milk, silica sand and so forth.

2. Description of the Prior Art

Recently, necessities have been voiced for shorter construction terms and lowered costs of architectural structures such as residences, with the result that a large number of prefabricated architectural structures have been constructed. For the architectural structures as defined above, there have been used various types of panel moldings including concrete, light-concrete, cellular concrete and the like. It has been desired that these moldings for architectural structures should be produced at high efficiency because of the necessities for lowered costs and so forth.

Now, the conventional molding tool devices for producing concrete panels and the like have been of such an arrangement that a plurality of side frames are detachably mounted on a bed, concrete is poured into a space defined by the side frames, solidified, cured, and thereafter, the side frames are removed to obtain the molding. Because of this, the molding tool devices have had to be held in the horizontal positions during curing of concrete, with the result that a large installation space has been required therefor and the releasing work has been performed at low efficiency.

In view of the abovedescribed circumstances, the present applicant has developed a light-weight cellular concrete panel, in which foams are added to slurry containing cement and silica sand as chief raw materials, cured and formed in a short period of time, and further steam-cured at a temperature of about 180° C. to obtain the panel, and has already proposed a release device, in which the panel is erected during curing and released in an erected state of the panel.

SUMMARY OF THE INVENTION

The present invention has as its object the provision of a molding tool device for forming a molding for an architectural structure suitable for use in a release device and the like for releasing the molding in an erected state.

According to the present invention, some side frame or frames out of a plurality of side frames mounted on a bed are detachably mounted on the bed and the remaining most side frames are rotatably or parallelly movably mounted on the bed, moving directions of these movable side frames are made identical with directions in which the side frames can be released from the respective side surfaces of the molding which is defined by the side frames, whereby the bed is erected such that the detachable side frame comes to the underside to support the molding on this side frame, while the other side frames are released from the molding so as to be released therefrom together with the bed, thereby enabling to achieve the abovedescribed object.

DETAILED DESCRIPTION OF THE PREFERRED EMBODIMENT

Figure 1:
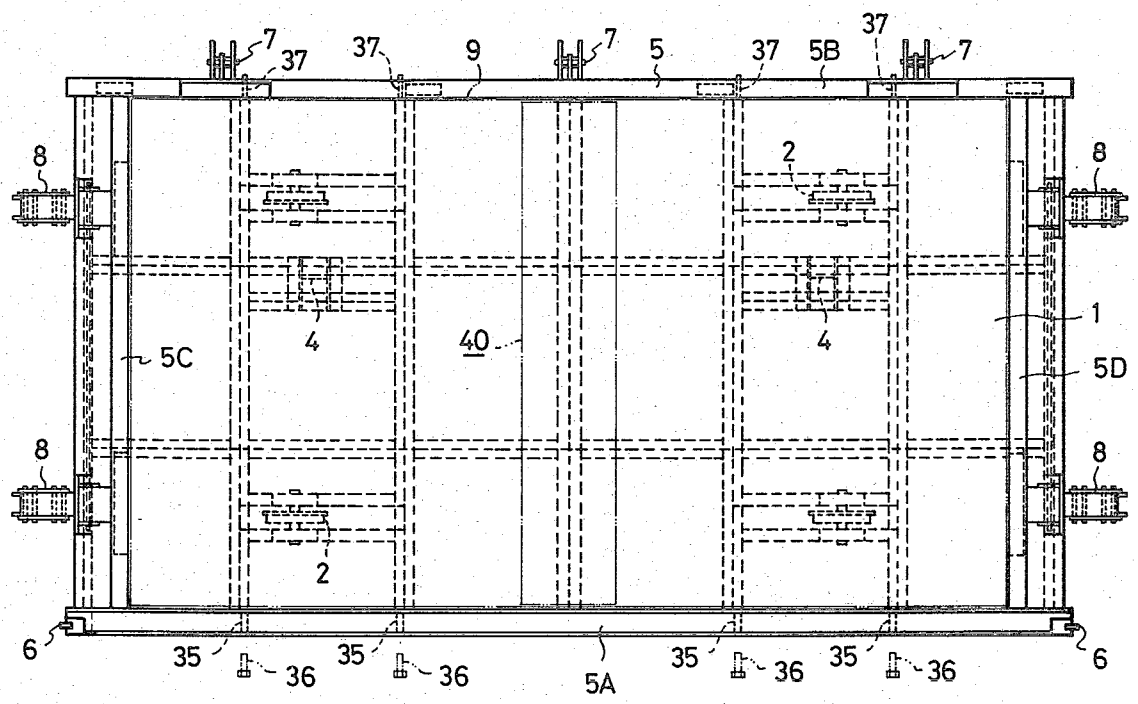
FIG. 1 is a plan view showing the general arrangement of one embodiment of the molding tool device according to the present invention.
Figure 2:
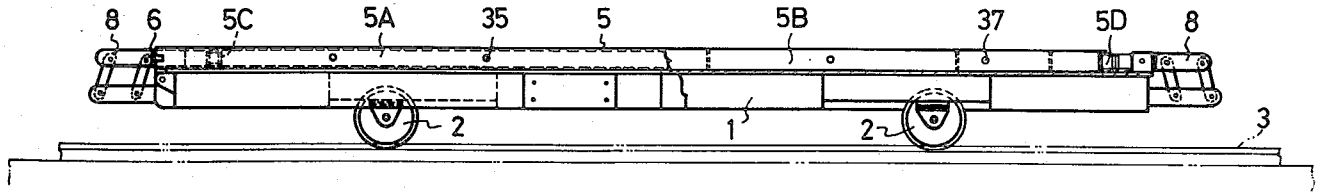
FIG. 2 is a partly sectional front view thereof.
Figure 3:
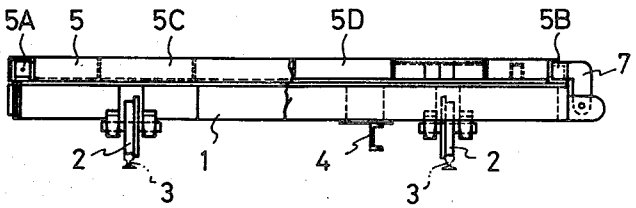
FIG. 3 is a partly sectional right side view thereof.

FIGS. 1 through 3 show the general arrangement of this embodiment, in which a bed 1 is constructed such that square steel plates are welded to the upper surfaces of I-shape steels arranged in a grate-like fashion and to the left side surface shown in FIG. 3, respectively, and a plurality of wheels, e.g. four wheels are rotatably secured to the undersurface of this bed 1. These wheels 2 are mounted on rails 3, so that the bed 1 can travel along these rails 3 to a given position. Furthermore, two engageable members 4 are provided at the undersurface of the bed 1 and adapted to be engaged with key-shaped engaging members of lock mechanisms of a shuttering erecting device, not shown, the bed 1 is fixed to the shuttering erecting device through the engagement with the lock mechanisms described above and the urging applied by an urging mechanism also provided on the shuttering erecting device and through the abutting against the left side surface of the bed 1 in FIG. 3, and, in this fixed state of the bed 1, when the shuttering erecting device is operated, the bed 1 is turned in the counterclockwise direction to be erected into a state where the bed 1 stands on the left side surface thereof shown in FIG. 3.

A plurality of side frames, e.g., four side frames 5 are arranged on the bed 1, and a side frame 5A shown below in FIG. 1 out of these four side frames 5 is detachably mounted on the bed 1, and fixed to the bed 1 by means of engaging members 6 which are provided at opposite end portions of this side frame 5A, penetrating therethrough and capable of fixing the side frame 5A to the bed 1. A side frame 5B shown above in FIG. 1 is connected to the bed 1 through first connectors 7 and the left and right side frames 5C and 5D are also connected to the bed 1 through second connectors 8 identical in shape with the first connectors 7, respectively. These side frames 5A, 5B, 5C and 5D are of square pillar forms, respectively, in which L-shape steels are combined with each other with their opening sides being opposed to each other. Cement milk, silica sand and other raw materials for a molding are poured into a space defined by the inner side surfaces of these side frames 5A through 5D, so that a molding 9 for use in an architectural structure such as a concrete panel can be formed.

Figure 4:
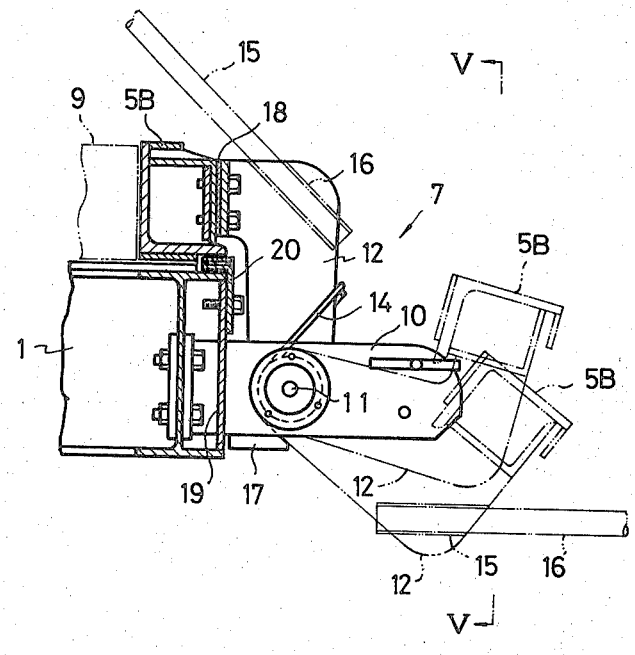
FIG. 4 is an enlarged side view showing a first connector in this embodiment.
Figure 5:
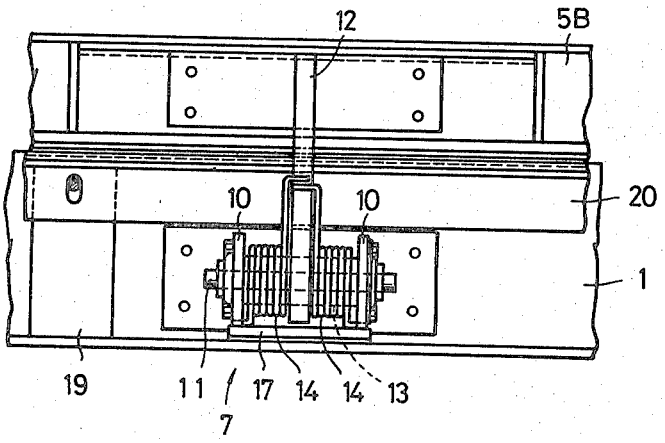
FIG. 5 is a view in the direction indicated by the arrows from line V—V in FIG. 4.

As enlargedly shown in FIGS. 4 and 5, the first connector 7 comprises: a bracket 10 projectingly provided on the side surface of the bed 1; a bell crank-shaped arm 12 rotatably supported at one end thereof by this bracket 10 through a shaft 11 and threadably secured at the other end thereof to the side frame 5B; two torsion coil springs 14 wound around the outer periphery of a hub 13 projectingly provided on a portion of this arm 12 engaged with the shaft 11, engaged at one end thereof with the arm 12 and engaged at the other end thereof with a side plate of the bracket 10 as an urging means for urging the arm 12 in the counterclockwise direction in FIG. 4; a tubular member 16 detachably mounted therein with a rod-like operating member 15, which is secured to a suitable connector 7 out of a plurality of connectors 7, e.g., the connector 7 disposed at the center in order to rotate the arm 12 against the resiliency of the springs 14; and a stopper 17 fixed to the bottom surface of the bracket 10 for regulating the rotation of the arm 12 by means of the operating member 15 against the resiliency of the springs 14; whereby the arm 12 is rotated by means of the operating member 15 against the resiliency of the springs 14 in the clockwise direction from a position indicated by solid lines to a position indicated by chain lines as shown in FIG. 4, thereby permitting the side frame 5B to move away from the side surface of the molding 9 defined by this side frame 5B. In this case, the position where the side frame 5B is secured to the arm 12 may be adjusted by means of a liner 18 interposed between the arm 12 and the side frame 5B, and further, a gap formed between the undersurface of the side frame 5B and the top surface of the bed 1 is adapted to be closed by means of a gap adjusting member 20 being L-shaped in cross section and secured to a plurality of support plates 19 (only one is shown in FIG. 5) through the agency of slots and the like in vertically adjustable manner, the support plates 19 being fixed to the side surface of the bed 1 at suitable intervals.

Figure 6:
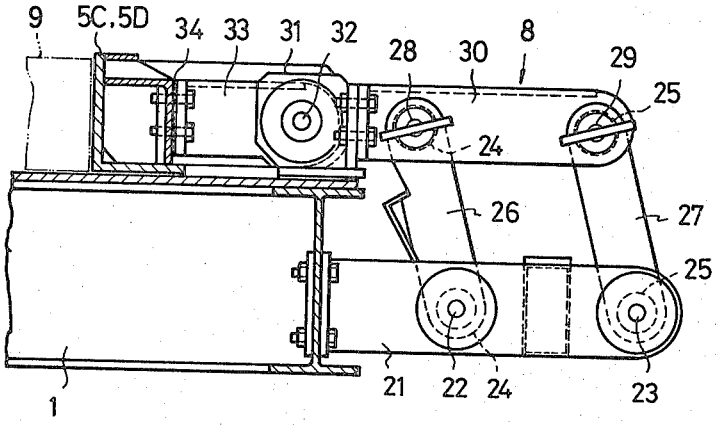
FIG. 6 is an enlarged side view showing a second connector in this embodiment.
Figure 7:
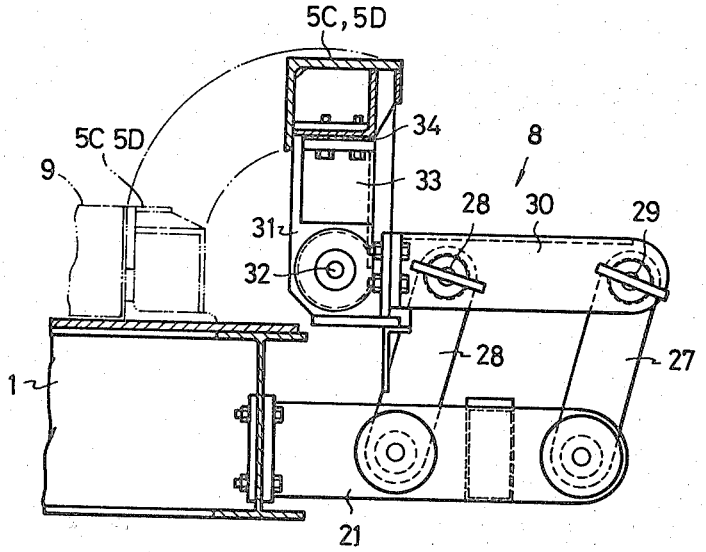
FIG. 7 is a view illustrating the second connector shown in FIG. 6 in an active position.

The second connector 8, as enlargedly shown in FIGS. 6 and 7, comprises: a bracket 21 projectingly provided on the side surface of the bed 1; links 26 and 27 rotatably connected at the respective ends thereof to this bracket 21 through shafts 22 and 23, and formed at the respective ends thereof, through which the shafts 22 and 23 extend, with tubular portions 24 and 25 and also formed at the other ends thereof with additional tubular portions 24 and 25, respectively; a second link 30 rotatably connected to the other ends of these links 26 and 27 through shafts 28 and 29 inserted through the tubular portions 24 and 25 of the links 26 and 27 and constituting a parallelogrammatic link in cooperation with these links 26, 27 and the bracket 21; a bearing mount 31 detachably secured to this second link 30; and an extension link 33 rotatably secured at one end thereof to this bearing mount 31 through a shaft 32 and detachably secured at the other end thereof to a left side frame 5C or a right side frame 5D; whereby the link 26 or 27 is rotated in the clockwise direction by means of the operating member, not shown, or directly by hand as shown in FIG. 7 and the extension link 33 is rotated about the shaft 32 also in the clockwise direction, thereby enabling to permit the side frame 5C or 5D to be released from the side surface of the molding 9 defined by the side frame 5C or 5D. In this case, the position where the side frame 5C or 5D is secured to the extension link 33 may be adjusted by means of a liner 34 interposed between the extension link 33 and the side frame 5C or 5D.

Figure 8:
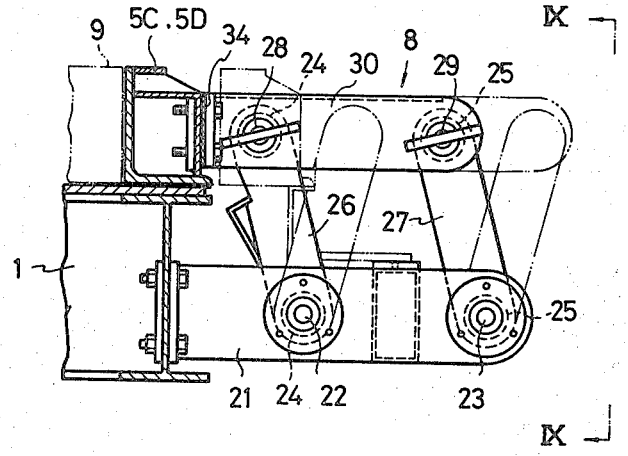
FIG. 8 is an enlarged side view showing the second connector in a different condition.
Figure 9:
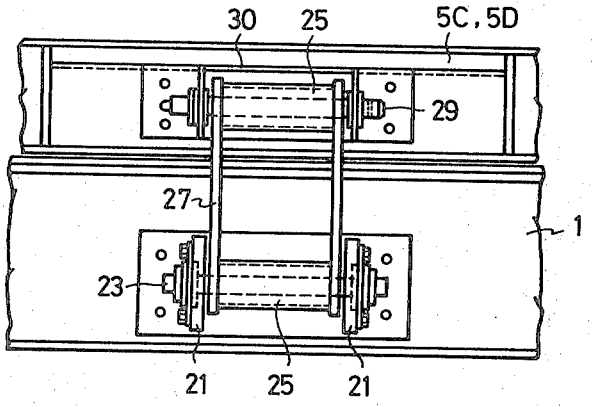
FIG. 9 is a view in the direction indicated by the arrows from line IX—IX in FIG. 8.

In FIGS. 8 and 9, there is shown a state where the bearing mount 31 of the second connector 8 and the extension link 33 are removed and the side frame 5C or 5D is directly secured to the link 30, so that the lateral dimension of the molding 9 as shown in FIG. 1 can be extended in forming.

Figure 10:
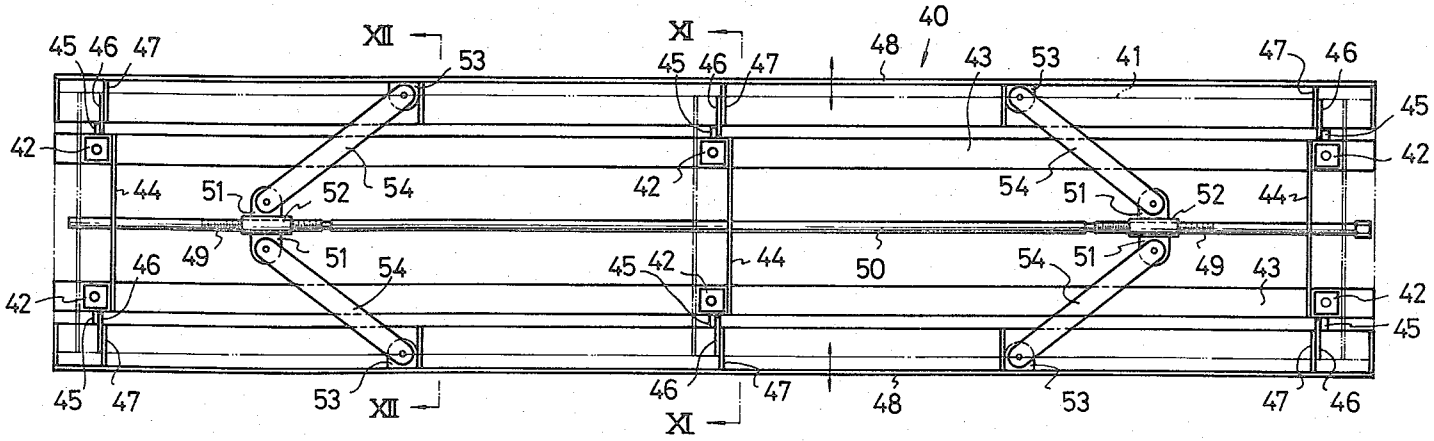
FIG. 10 is an enlarged plan view showing the partitioning mechanism in this embodiment.
Figure 11:
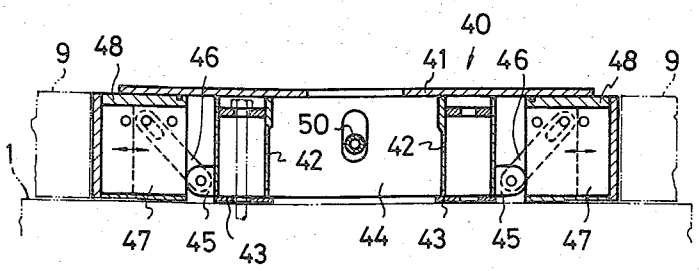
FIGS. 11 and 12 are enlarged sectional views in the directions indicated by the arrows from lines XI—XI and XII—XII in FIG. 10, respectively.
Figure 12:
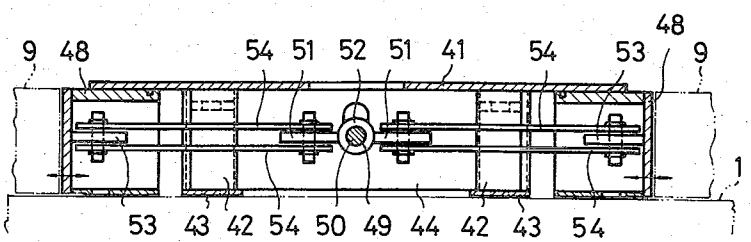

In FIGS. 10 through 12, there is shown a partitioning mechanism 40, which can be detachably secured to the central portion in the lateral direction of the bed 1 as shown in FIG. 1 and used when two moldings 9 short in dimension in the lateral direction are to be produced at the same time. This partitioning mechanism 40 comprises: an elongate rectangular top plate 41; a pair of long strip-like bottom plates 43 connected to this top plate 41 through three supports being which are square in cross section, respectively; connecting plates 44 racked across the opposing three supports 42 erected from these bottom plates 43; six links 46 each rotatably connected at one end thereof to each of brackets 45 projectingly provided on the outer side surfaces of the supports 42; i.e., the upper and lower side surfaces of the supports 42 in FIG. 10; a pair of slidable casings 48 being U-shaped in cross section secured to the other ends of these links 46 through mounting plates 47 in a manner to be changeable in mounting positions; an operating shaft 50 extending through the centers of the three connecting plates 44, provided at portions close to the opposite ends thereof with threaded portions 49 formed in directions opposite to each other and connected at the central portion thereof to each other through a pipe member; threaded tubes 52 threadably coupled to the respective threaded portions 49 of this operating shaft 50 and projectingly provided at opposite sides thereof with connecting collars 51; and working links 54 each rotatably connected at one end thereof to each of the connecting collars 51 of the threaded tubes 52 and rotatably connected at the other end thereof to each of brackets 53 projectingly provided on the inner walls of the slidable casings 48. This partitioning mechanism 40 is detachably secured to the base 1 through holes formed in the supports 42, and, when the operating shaft 50 is rotated, the both threaded tubes 52 are moved through the both threaded portions 49 to the right and left in FIG. 10, whereby the mounting angles of the working links 54 in FIG. 10 are changed, so that the both slidable casings 48 can be moved in directions indicated by arrows in the drawing.

In addition, designated at 35 in FIGS. 1 and 2 are through-holes formed in the side frames 5A, and locking bolts 36 are threaded into the molding 9 through three through-holes 35. Additionally, denoted at 37 are provisional locking bolts threadably coupled to nuts integrally formed in the molding 9.

Figure 13:
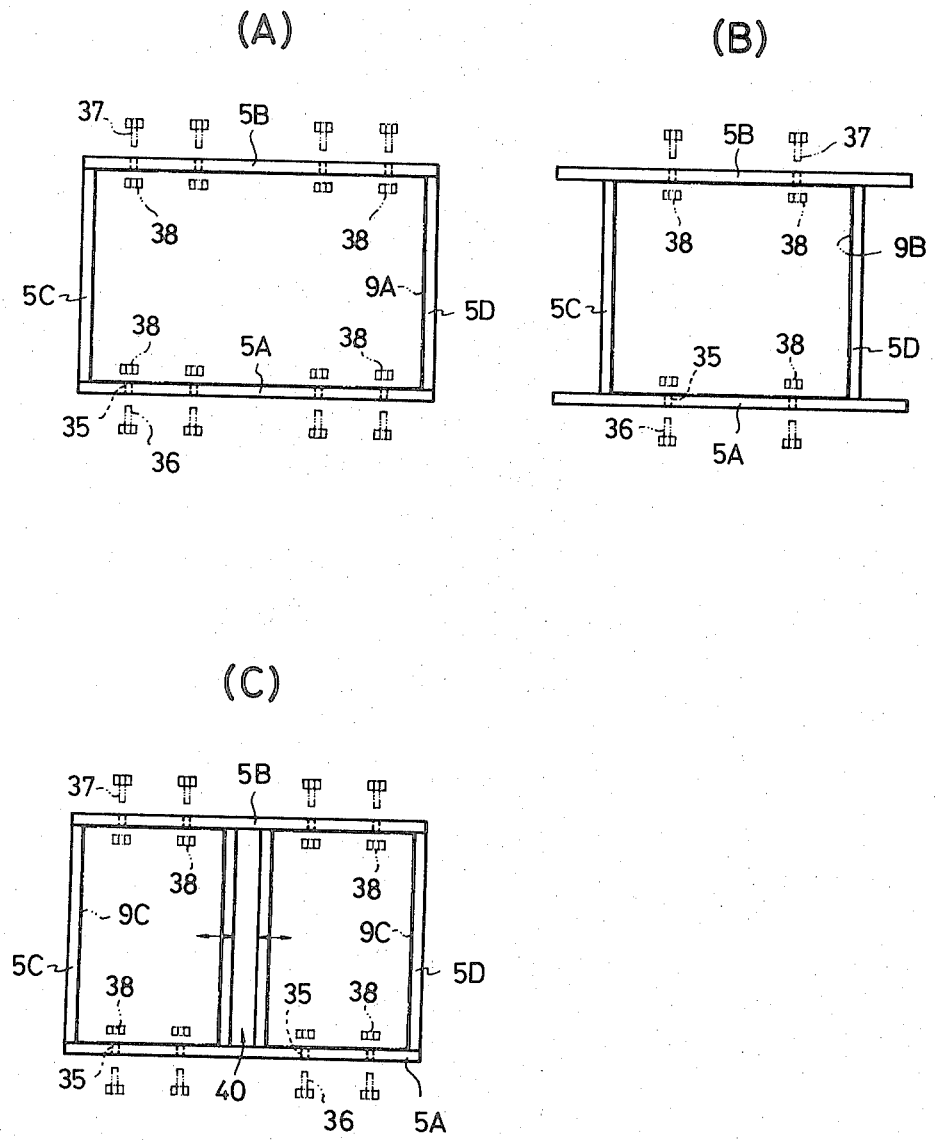
FIGS. 13A through 13C are views in explanation of the use method of this embodiment.

Description will now be given of method of forming a molding by use of this embodiment with reference to FIGS. 13A through 13C as well.

In order to form a large-size panel-shaped molding 9A shown in FIG. 13A, the connectors 8 of the left and right side frames 5C and 5D shown in FIG. 1 are used in a state where the bearing mount 31 and the extension link 33 are removed therefrom as shown in FIGS. 8 and 9.

In the state as described above, the side frame 5A shown below in FIG. 1 is fixed onto the bed 1 by means of the engaging members 6 and the side frame 5B shown above is positioned on the bed 1 through the resiliency of the torsion coil springs 14, and further, the left and right side frames 5C and 5D are positioned on the bed 1 as indicated by solid lines in FIG. 8, whereby a rectangular space is defined by these side frames 5A through 5D.

Subsequently, the raw materials for a molding, such as cement milk and so forth, are poured into the space defined by the side frames 5A through 5D to form a large-size molding 9A, and the bed 1 as a whole under the abovedescribed condition is moved along the rails 3 onto the shuttering erecting device. During this movement, the molding 9A is temporarily cured and brought into a solidified state to some extent, while the bed 1, which has moved onto the shuttering erecting device, is urged and held in place through the engagement of the engageable members 4 provided at the undersurface of the bed 1 with the lock mechanism and the urging mechanism applied to the left side surface as shown FIG. 3 of the bed 1 by the urging mechanism of the shuttering erecting device.

Subsequently, the shuttering erecting device is operated to cause the bed 1 to stand on the left side surface thereof as shown in FIG. 3. Under this condition, the engaging members 6 are removed automatically or manually, whereby the side frame 5A is supported on a side frame receiving mechanism provided on the shuttering erecting device, the remaining side frames 5B, 5C and 5D are automatically or manually moved away from the side surfaces of the molding 9A, respectively, so that only the molding 9A can be supported on the side frame 5A as in the erected state.

While the side frame receiving mechanism of the shuttering erecting device is held in the same position as before, the bed 1 is laid down together with the urging mechanism and the lock mechanism. Thereafter, the side frame 5A, which has been left on the side frame receiving mechanism, is taken out of the side frame receiving mechanism together with the molding 9A in a state of being erected by forks provided on a form carry-out carrier, transferred to an autoclave where normal curing is effected, further, the side frame 5A is removed therefrom, thus enabling to finally obtain the molding 9A.

Furthermore, in order to form a medium-size panel-shaped molding 9B shown in FIG. 13B, the connectors 8 of the left and right side frames 5C and 5D shown in FIG. 1 are used in a state where the bearing mount 31 and the extension link 33 are mounted thereon as shown in FIGS. 6 and 7, and the process of forming is entirely identical with that in the case of forming the large-size molding 9A.

Further, in order to form two small-size panel-shaped moldings 9C shown in FIG. 13C at a time, the partitioning mechanism 40 shown in FIGS. 10 through 12 is mounted at the center of the bed 1 in the lateral direction in FIG. 1, and the connectors 8 of the left and right side frames 5C and 5D are used in a state shown in FIGS. 8 and 9. In this state, the forming process from the pouring of the raw materials for a molding to the erecting of the bed 1 and releasing of the side frames 5B through 5D at the three sides is quite similar to that in the case of forming the large-size molding 9A, and, after this erecting of the bed 1, the work of removing the partitioning mechanism 40 from the moldings 9C is performed.

The work of removing the partitioning mechanism 40 is performed in the following manner. Namely, rotation of the operating shaft 50 causes the threaded tubes 52 threadably coupled to the threaded portions 49 of the operating shaft 50 to move away from each other in FIG. 10, whereby the working links 54 are rotated in directions of decreasing the degrees of inner angles thereof, so that the both slidable casings 48 connected to the supports 42 through the links 46 can move to approach each other, thereby enabling the both slidable casings 48 to be released from the side surfaces of the moldings 9C.

Subsequently, the bed 1 is laid down together with the partitioning mechanism 40 thus released, thereafter, the both moldings 9C are transferred to the autoclave together with the side frame 5A in the same manner as in the case of the large-size molding 9A, and further, the side frame 5A is removed, thus enabling to finally obtain the moldings 9C.

As for the locking bolts 36 and the provisional locking bolts 37 which are threadably coupled to the nuts 38 (refer to FIG. 13) integrally formed on the respective moldings 9A, 9B and 9C, when the side frame 5B is released, the provisional locking bolts 37 are removed and replaced with suspending bolts, not shown, and, when the side frame 5A is released, the locking bolts 36 are removed. Additionally, the number of the mounted bolts 36 and 37, i.e., the number of the embedded nuts 38, is such that the large-size molding 9A has four at one side and hence eight in total at both sides, and the medium-size and small-size moldings 9B and 9C respectively has two at one side and hence four in total at both sides.

Further, under the condition shown in FIG. 13C, if the extension links 33 are mounted on the connectors 8 of the left and right frames 5C and 5D and the connecting positions between the links 46 and the both slidable casings 48 in the partitioning mechanism 40 are changed, then the dimensions of the molding 9 can be varied.

With the abovedescribed arrangement of this embodiment, one side frame 5A is made detachable from the bed 1, while the remaining side frames 5B through 5D are movably secured to the bed 1, so that the molding tool device to which the method of forming a molding, in which the molding 9 is released in an erected state, can be provided. Furthermore, the extension link 33 is detachably secured to the second connector 8 and the partitioning mechanism 40 is detachably mounted on the bed 1, so that moldings 9 of varied dimensions can be efficiently produced by use of one and the same bed 1. Further, in forming the molding 9, only one side frame 5A is used during normal curing of the molding 9, and the bed 1 and the side frames 5B through 5D are released on the way, so that the bed and the side frames 5B through 5D can be used for the succeeding formation, thereby enabling to make efficient use of the molding tool device.

It should be understood, however, that, in working the present invention, there is no intention to limit the invention to four side frames which form a square shape, but on the contrary, the invention is to cover all modifications including three side frames for forming a triangular shape or five or more side frames for forming polygons such as a pentagon or others. In that case, some of the side frames out of the plurality of side frames should be made detachable from the bed and the remaining most side frames should be movably mounted on the bed so as to be released together with the bed from the molding. Furthermore, the side frame or frames movably mounted on the bed are not limited to ones movable in the rotating directions as in the abovedescribed embodiment, but, may be movable in the rectilinear directions. In short, the respective side frames should be movable in directions of being released from the side surfaces of the molding defined by those side frames.

As has been described hereinabove, the present invention can offer such an advantage as to provide a molding tool device for a molding used in an architectural structure, being suitable for use in a releasing device and the like, in which the releasing is effected in an erected state.

What is claimed is:

1. A molding tool device for a molding used in an architectural structure, comprising: a bed positionable to receive thereon material for molding; a plurality of side frames arranged on said bed to define a molding space of a given shape; connectors fastening ones of said side frames to said bed and movable for retracting said ones of said side frames from the corresponding side surfaces of the molding formed in said molding space; means located on said bed for underlying and supporting the bottom edge surface of the molding with the bed and molding erected from their molding position, which means comprise a further said side frame detachably mounted on said bed for removal therefrom of said bed.

2. A molding tool device for a molding used in an architectural structure as set forth in claim 1, wherein a said connector comprises: a bracket projecting from the bed; an arm rotatably supported at one end thereof by said bracket and fixed at the other end thereof to a side frame; and coil springs confined between said arm and said bracket for urging said side frame to a position for defining the external shape of the molding.

3. A molding tool device for a molding used in an architectural structure as set forth in claim 2, wherein said arm has detachably secured thereto an operating member for rotating said arm against the resiliency of the coil springs, and a stopper for regulating the rotation of said arm fixed to the bottom surface of the bracket in said connector.

4. A molding tool device for a molding used in an architectural structure as set forth in claim 1, wherein a said connector comprises: a bracket projectingly provided on the side surface of the bed; first links having respective ends rotatably supported on said bracket; and a second link rotatably supported at the other ends of said links to constitute a parallelogram linkage in cooperation with said first links and said bracket.

5. A molding tool device for a molding used in an architectural structure as set forth in claim 4, including an extension link, one end of which is rotatable with respect to and detachably secured to said second link and the other end of which is detachably secured to the side surface of one of said side frames for rotatably supporting said side frame on said second link to reduce the width of the molding space, the position where the side frame is secured to said extension link being adjustable by means of a liner interposable between said extension link and the side frame.

6. A molding tool device for a molding used in an architectural structure as set forth in claim 1, including a partitioning mechanism supportable atop said bed for dividing said molding space into a plurality of spaces and for simultaneous support by said detachable further side frame of the bottom end surfaces of a plurality of moldings in the erected position of said bed and moldings.

7. A molding tool device for a molding used in an architectural structure as set forth in claim 6, wherein said partitioning mechanism comprises: a center part having a rectangular top plate, a pair of bottom plates fixable atop said bed and fixedly supporting said top plate in spaced relation thereabove by upstanding supports, and connecting plates fixedly spacing the opposing supports upstanding from said pair of bottom plates for spacing the latter; links each pivotably connected at one end thereof to brackets projecting from the outer side surfaces of the supports; and a pair of casings slidable on said bed on opposite sides of said center part, said casings being pivotably secured to the other ends of said links by mounting plates and mounting position adjustment means.

8. A molding tool device for a molding used in an architectural structure as set forth in claim 7, wherein said partitioning mechanism further comprises: an operating shaft extending through said connecting plates and having threaded portions; and working links each pivotably connected at one end thereof to a tube threaded on said operating shaft and pivotably connected at the other end thereof to a bracket on a corresponding said slidable casing; whereby said slidable casings being slidable inwards or outwards with respect to said center part by the rotation of said operating shaft.

9. A molding tool device for a molding used in an architectural structure as set forth in claim 1, in which said bed has a horizontal position for receiving material to be molded and partial solidification of the resultant molding thereon, said bed having engageable means engageable for turning said bed to stand on one side thereof and supporting the molding on said further side frame, said connectors including a first part fixed to said bed, a second part secured to and shiftable with respect to said first part in a direction away from said molding and means fixedly mounting the corresponding said ones of said side frames on said second part and maintaining said ones of said side frames continuously secured to said bed for movement therewith, said molding tool device further including engaging means for removably fixing said further side frame to said bed.

10. A molding tool device for a molding used in architectural structure, as set forth in claim 9, wherein said molding space is rectangular, said ones of said side frames being adjacent the top and end edges of said bed and said further side frame being at the bottom edge thereof, said connectors extending outward beyond said top and side edges of said bed, said further side frame at the bottom edge of said bed being free of such connectors, said engaging means being located to removably fix the ends of said further side frame to said bed and not extending beyond the bottom edge of said bed, said further side frame extending along the major length of said rectangular molding space.

11. A molding tool device for a molding used in an architectural structure as set forth in claim 10, in which said side frames at said end edges of said bed are disposed between said side frames at said top and bottom edges of said bed and have their connectors provided with means for adjustably shifting same inboard from said end edges of said bed to reduce the length of said molding space for producing a narrower molding.

* * * * *